United States Patent [19]

Hipkins, Jr. et al.

[11] Patent Number: 4,477,209

[45] Date of Patent: Oct. 16, 1984

[54] ANCHOR BOLT ASSEMBLY

[75] Inventors: Edward C. Hipkins, Jr., Coraopolis; Frank M. Locotos, Bridgeville, both of Pa.

[73] Assignee: H & S Machine & Supply Co., Inc., Oakdale, Pa.

[21] Appl. No.: 374,515

[22] Filed: May 3, 1982

[51] Int. Cl.[3] ..... E21D 20/02

[52] U.S. Cl. ..... 405/261; 405/259; 411/2; 411/5

[58] Field of Search ..... 405/259, 261, 260, 3-5; 411/2, 60, 61; 285/3

[56] References Cited

U.S. PATENT DOCUMENTS

| | | | |
|---|---|---|---|
| 1,692,710 | 11/1928 | Spahn | 285/3 X |
| 3,104,582 | 9/1963 | White | 411/60 |
| 3,877,235 | 4/1925 | Hill | 405/261 |
| 4,051,683 | 10/1977 | Koval | 405/261 |
| 4,122,753 | 10/1978 | Kuhlmann et al. | 411/2 |
| 4,132,080 | 1/1979 | Hansen | 405/261 |
| 4,223,740 | 9/1980 | Clayton | 285/3 X |
| 4,295,761 | 10/1981 | Hansen | 405/259 X |
| 4,347,020 | 8/1982 | White et al. | 405/259 X |

*Primary Examiner*—Dennis L. Taylor

*Attorney, Agent, or Firm*—Webb, Burden, Robinson & Webb

[57] ABSTRACT

The anchor bolt assembly is of the type used in mine roofs where the anchor bolt is assembled and positioned in a drill hole in a rock formation and in which quick-setting adhesives secure the assembly to the rock formation. The assembly includes an elongated reinforcing rod, an elongated bolt, and a coupling internally threaded at each end and connected to the rod and bolt. A cylindrical plug of aluminum is positioned within the bore of the coupling and frictionally engaged by the threads so as to permit the entire assembly to turn in a first position and to disengage from its frictional engagement to permit turning of only the elongated bolt in a second position.

2 Claims, 4 Drawing Figures

ANCHOR BOLT ASSEMBLY

DESCRIPTION

1. Field of the Invention

Our invention relates to anchor bolt assemblies and more particularly to anchor bolt assemblies of the type used in mine roofs where the anchor bolt assembly is positioned in a drill hole of a rock formation and in which a quick-setting adhesive secures the assembly to the rock formation.

2. Description of the Prior Art

The early developments in the area of anchor bolt assemblies used in coal mines and other forms of construction in subterranean rock formations were directed to various types of expansion devices which were inserted into a bore hole in the rock formation and thereafter expanded to provide a griping action between the anchor bolt assembly and the rock formation.

A more recent and generally more acceptable development has been the use of quick-setting adhesive type bolting systems. In such a system, a hole is bored into the mine roof or other rock structure. A capsule or series of capsules containing a quick-setting adhesive resin and a catalyst hardener is positioned at the blind end of the bore hole. An anchor bolt assembly which generally consists of a piece of reinforcing rod and an elongated bolt joined by a coupling threadably joined therebetween is positioned in the bore hole and the entire anchor bolt assembly is rotated so as to rupture the capsules and permit mixing of the adhesive and the catalyst. Existing resin systems set within a period of minutes to permanently secure the reinforcing rod to the rock formation and thereafter only the bolt is rotated so that a bearing plate adjacent the bolt head abuts the face of the surface about the bore hole.

The two basic positions or movements of the anchor bolt assembly are a first position in which the entire assembly rotates to cause rupturing and mixing of the resin adhesives. The second position permits only the bolt to turn while the remainder of the assembly remains rigid. To accomplish these two different positions, a number of systems have been developed. One such system is disclosed in U.S. Pat. No. 3,877,235 wherein a coupling is closed off at its ends by back and front welded endwalls of a metal such as steel. A standard nut is welded to the front endwall and the bolt is secured to the nut against the endwall in the first position and thereafter the bolt is torqued to displace, shear, or fracture and penetrate the front wall to permit the bolt to enter the coupling or pipe member.

Other systems such as those disclosed in U.S. Pat. Nos. 4,051,683 and 3,896,627 employ pins which extend through the coupling to act as a stop in the first position and thereafter the pin is sheared as the bolt advances in the coupling.

Another system for providing a temporarty stop is the utilization of a length of neoprene rubber cord which is inserted in the coupling so that as the bolt is advanced the rubber is compressed between the end of the bolt and the reinforcing rod. The composition of the rubber is such that sufficient resistance is offered so as to permit the entire anchor to rotate in the first position and thereafter the rubber is squeezed out of an appropriate opening in the side of the coupling as additional torquing takes place in the second position.

One of the shortcomings with the use of end plates is that several additional welding operations must take place including welding a nut to the end plate. In addition, fracturing of the end plate can result in galling of the threads and therefore torquing can be effected by the damaged threads. The use of pins has led to premature breaking effecting the initial setting operation and when the breaking does occur the threads are susceptible to galling from the pin and the resultant torquing pitfalls associated therewith. While the use of a neoprene rubber cord avoids the galling problem, the rubber must be squeezed out of an appropriate opening thereby adding another factor to the torquing requirements of the bolt. In practice, it has been found that some 250 to 300 ft. lbs. of torque is required to extrude the rubber out of the opening.

SUMMARY OF THE INVENTION

Our invention eliminates the potential for galling of the threads and premature breakage of the stop member. At the same time, excessive or burdensome torquing requirements are not encountered. Further, our invention is easily assembled and constant and reproducible results are achieved during the torquing operations.

Our anchor bolt assembly includes an elongated reinforcing rod, an elongated bolt, and a coupling internally threaded at each end for connecting the rod and bolt in an assembled condition. The improvement comprises utilizing a cylindrical plug of material softer than the coupling such as aluminum which is frictionally engaged within the coupling bore and to the threads for engagement by the bolt to permit turning of the entire assembly in a first position and to have the plug disengaged such as by turning from its frictional engagement to permit torquing of only the elongated bolt in a second position.

DESCRIPTION OF THE PREFERRED EMBODIMENT

Figure 1:
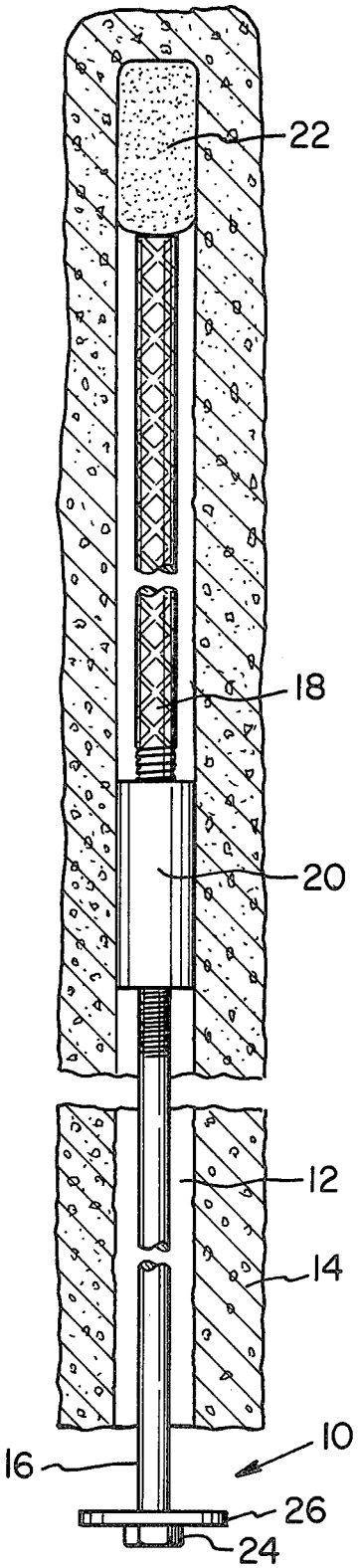
FIG. 1 is a section through a rock formation having a bore hole with the roof bolt assembly in place prior to rupture of the resin capsule.

Our roof bolt assembly, generally designated 10, is an elongated member often reaching lengths of six to eight feet or longer, FIG. 1. The assembly is positioned in a bore hole 12 in a mine roof or other rock formation 14. A quick-setting resin capsule 22 is positioned in the blind end of the bore hole 12 and can be any one of a number of conventional capsules and systems used for that purpose and which do not form a part of this invention. Capsule 22 includes a quick-setting adhesive resin and a catalyst which, when mixed with the resin, causes quick-setting in the annulus form between the upper portion of the roof bolt assembly 10 and the rock formation 14.

Figure 4:
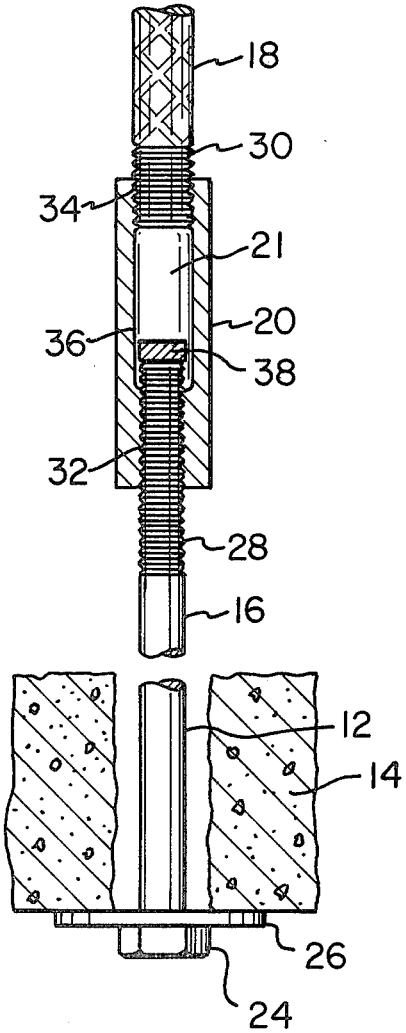
FIG. 4 is a section through the rock formation of FIG. 1 showing the roof bolt assembly as it is finally installed.

The roof bolt assembly 10 includes an elongated bolt 16, an elongated reinforcing rod 18, and a coupling 20 joining the bolt 16 and the reinforcing rod 18 in assembled position, FIGS. 1 and 4. Reinforcing rod 18 includes threads 34 at one end and elongated bolt 16 includes threads 28 at one of its end. At the other end of bolt 16 is a hex bolt head 24 or other wrench or socket engaging surface. Positioned adjacent to or as part of the bolt head 24 is a bearing plate 26. Everything described heretofore is conventional equipment and structure for existing roof bolt or anchor bolt assemblies.

Figure 2:
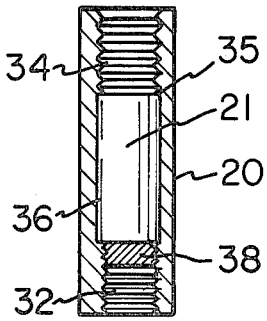
FIG. 2 is a section through the coupling containing the plug of our invention.

The coupling 20 defines an internal bore 21 and includes an internal thread 34 at the reinforcing rod end of the coupling and an internal thread 32 at the elongated bolt end of the coupling, FIG. 2. Intermediate the threads 34 and 32 and within the bore 21 is an unthreaded portion 36. A stop 35 such as a shoulder or enlarged bottom thread is positioned at the internal end of thread 34 to limit the movement of the reinforcing rod.

Figure 3:
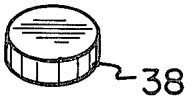
FIG. 3 is a perspective view of the plug.

A plug of aluminum 38 is positioned within the bore 21 of coupling 20 and, more particularly, is frictionally engaged by the threads 32 at the bolt end of coupling 20, FIGS. 2 and 3. Plug 38 is installed in the coupling by positioning it in the bore and setting the coupling over a fixed mandrel (not shown) which extends into the bolt end of the coupling 20. Thereafter, a punch (not shown) is inserted in the reinforcing bar end of coupling 20 and is caused to engage plug 38 in a compression mode to extrude the aluminum into the threads 32. Since the aluminum is appreciably softer than the coupling 20 (made of steel) the plug easily extrudes in place with the coupling threads acting as the die mold.

Thereafter the elongated bolt 16 is threaded into engagement with threads 32 of the coupling 20 until bolt 16 engages plug 38 to stop its forward advancement, FIG. 1. The reinforcing rod 18 is threaded into engagement with threads 34 at the other end of coupling 20. Rod 18 is advanced until it engages stop 35 at the end of the threads so the coupling rotates with rod 18. The roof bolt assembly is then inserted into the drill bore 12 with the capsule 22. Since the elongated bolt 16 is in engagement with aluminum plug 38 and rod 18 engages stop 35 rotation of the square or hex head 24 causes the entire assembly 10 to rotate and rupture and mix the resin adhesive in capsule 22. After setting of the resin takes place, additional torquing is supplied to elongated bolt 16. Since the reinforcing bar is now held rigidly in place, it can no longer turn and as the bolt 16 advances further into coupling 20, the plug 38 rotates within the threads and with bolt 16 until the plug 38 leaves the threaded section 32 and enters the unthreaded section 36, FIG. 4. Thereafter, no resistance to torquing is encountered as the result of the plug 38. Since the plug 38 actually threads its way out of engagement with the internal threads 32, no galling takes place to the threads and thus rotation of the bolt 16 is not hampered. Bearing plate 26 is now engaged with the face of the rock formation 14 and the appropriate torque is applied to head 24 with a torque wrench or the like.

A typical coupling will be approximately 4 inches long and have a diameter on the order of $1\frac{1}{4}$ inches. The bolt end of the coupling will be tapped to a depth of $1\frac{1}{4}$ inches with threads having a $\frac{3}{4}$ inch pitch diameter and the reinforcing rod end of the coupling will be tapped to a depth of $1\frac{1}{8}$ inch with threads having a $\frac{7}{8}$ inch pitch diameter. The aluminum plug has a thickness on the order of a $\frac{1}{4}$ inch and is extruded into the bore threads so as to be substantially at the inner end of the unthreaded section of the coupling bore. When the plug is installed in the coupling as described hereinbefore, it takes approximately 100 ft. lbs. of torque to break the plug loose. As stated, the plug actually screws out of the threads in advance of the elongated bolt, thereby eliminating thread damage, premature failure and excessive torque requirements. Results to date have been consistent and reproducible.

We claim:

1. In an anchor bolt assembly of the type used in mine roofs and the like where the anchor bolt assembly is positioned in a drill hole of a rock formation and in which a quick-setting adhesive secures the assembly to the rock formation, said assembly including an elongated reinforcing rod, an elongated bolt and a coupling internally threaded at each end and connecting the rod and bolt, the improvement comprising a cylindrical plug of a material which is softer than the coupling, said plug extruded into frictional engagement within the internal threads of a bolt end of the coupling bore at substantially an inner end of said threads for engagement by said bolt to permit turning of the entire assembly in a first position and after approximately the application of 100 ft. lbs. of torque, to disengage from its frictional engagement to permit turning of the elongated bolt in a second position, said coupling including a nonthreaded section between the threaded ends, said plug being disengaged from the threads so as to locate in the nonthreaded section in the second position.

2. The improvement of claim 1, said metal plug being aluminum.

* * * * *